US009187798B2

(12) United States Patent
Takenaka et al.

(10) Patent No.: US 9,187,798 B2
(45) Date of Patent: Nov. 17, 2015

(54) METHOD FOR MANUFACTURING GRAIN ORIENTED ELECTRICAL STEEL SHEET

(75) Inventors: Masanori Takenaka, Tokyo (JP); Minoru Takashima, Tokyo (JP); Toshito Takamiya, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 307 days.

(21) Appl. No.: 13/703,833

(22) PCT Filed: Jun. 17, 2011

(86) PCT No.: PCT/JP2011/003489

§ 371 (c)(1), (2), (4) Date: Dec. 12, 2012

(87) PCT Pub. No.: WO2011/158519

PCT Pub. Date: Dec. 22, 2011

(65) Prior Publication Data

US 2013/0087249 A1 Apr. 11, 2013

(30) Foreign Application Priority Data

Jun. 18, 2010 (JP) ..... 2010-139195
Jun. 17, 2011 (JP) ..... 2011-134923

(51) Int. Cl.
*H01F 1/04* (2006.01)
*C21D 8/00* (2006.01)
(Continued)

(52) U.S. Cl.
CPC ..... *C21D 8/0205* (2013.01); *C21D 8/12* (2013.01); *C21D 8/1216* (2013.01); *C21D 8/1244* (2013.01); *C22C 38/004* (2013.01);
(Continued)

(58) Field of Classification Search
CPC ..... C21D 8/0205
See application file for complete search history.

(56) References Cited

U.S. PATENT DOCUMENTS 4,468,551 A * 8/1984 Neiheisel ..... 219/121.6
4,919,733 A * 4/1990 Salsgiver et al. ..... 148/113
(Continued)

FOREIGN PATENT DOCUMENTS

CN 1400319 A 3/2003
CN 101395284 A 3/2009
(Continued)

OTHER PUBLICATIONS

Y. Ros-Yañez, Y. Houbaert, O. Fischer, J. Schneider. "Production of high silicon steel for electrical applications by thermomechanical processing." Journal of Materials Processing Technology. 141 (2003) 132-137.*
(Continued)

*Primary Examiner* — Keith Walker
*Assistant Examiner* — Stephani Gulbrandsen
(74) *Attorney, Agent, or Firm* — Oliff PLC

(57) ABSTRACT

The present invention provides a method for manufacturing a grain oriented electrical steel sheet, including preparing as a material a steel slab having a predetermined composition and carrying out at least two cold rolling operations, characterized in that a thermal treatment is carried out, prior to any one of cold rolling operations other than final cold rolling, at temperature in the range of 500° C. to 750° C. for a period in the range of 10 minutes to 480 hours. The grain oriented electrical steel sheet of the present invention exhibits through utilization of austenite-ferrite transformation superior magnetic properties after secondary recrystallization.

17 Claims, 3 Drawing Sheets

(51) Int. Cl.

| | |
|---|---|
| ***C22C 38/02*** | (2006.01) |
| ***C21D 8/02*** | (2006.01) |
| ***C21D 8/12*** | (2006.01) |
| ***C22C 38/00*** | (2006.01) |
| ***C22C 38/06*** | (2006.01) |
| ***H01F 1/16*** | (2006.01) |

(52) U.S. Cl.
CPC ..... *C22C 38/02* (2013.01); *C22C 38/06* (2013.01); *H01F 1/16* (2013.01); *C21D 2201/05* (2013.01)

(56) References Cited

U.S. PATENT DOCUMENTS

| | | | | |
|---|---|---|---|---|
| 2009/0126832 | A1 | 5/2009 | Ushigami et al. | |
| 2009/0165895 | A1* | 7/2009 | Ushigami et al. ..... | 148/208 |
| 2012/0312424 | A1* | 12/2012 | Murakami et al. ..... | 148/208 |

FOREIGN PATENT DOCUMENTS

| | | | |
|---|---|---|---|
| CN | 101432450 | A | 5/2009 |
| CN | 101454465 | A | 6/2009 |
| JP | B-40-015644 | | 7/1965 |
| JP | A-50-099914 | | 8/1975 |
| JP | S5099914 | A | 8/1975 |
| JP | A-63-259024 | | 10/1988 |
| JP | A-06-145799 | | 5/1994 |
| JP | B2-2648424 | | 8/1997 |
| JP | A-2001-060505 | | 3/2001 |
| JP | A-2005-133175 | | 5/2005 |
| JP | A-2006-299297 | | 11/2006 |
| JP | A-2008-001981 | | 1/2008 |
| JP | B2-4123653 | | 7/2008 |

OTHER PUBLICATIONS

JP50099914A written translation.*

International Preliminary Report on Patentability issued in International Application No. PCT/JP2011/003489 dated Jan. 15, 2013.

Jun. 6, 2014 Office Action and Search Report issued in Chinese Application No. 201180030164.3 (with English translation).

F. Brailsford, "Investigation of the Eddy-Current Anomaly in Electrical Sheet Steels", *Inst. Elec. Engrs. 95*[*II*], 1948, pp. 38-48.

International Search Report issued in International Application No. PCT/JP2011/003489 dated Sep. 6, 2011.

Office Action issued in Chinese Application No. 201180030164.3 dated Jul. 30, 2013 (with translation).

Office Action issued in Canadian Application No. 2,802,019 issued May 30, 2014.

Office Action issued in Russian Application No. 2013102244 issued Apr. 10, 2014 (with translation).

Mar. 24, 2015 Office Action issued in Japanese Application No. 2011-134923.

Canadian Office Action issued in Canadian Application No. 2,802,019 mailed Sep. 11, 2013.

Jun. 30, 2015 Office Action issued in Applicaion No. MX/a/2012/014728.

* cited by examiner

METHOD FOR MANUFACTURING GRAIN ORIENTED ELECTRICAL STEEL SHEET

TECHNICAL FIELD

The present invention relates to a method for manufacturing what is called a "grain oriented electrical steel sheet" in which crystal grains are accumulated in {110}<001> orientation.

PRIOR ART

It is known that a grain oriented electrical steel sheet having crystal grains accumulated in {110}<001> orientation (which orientation will be referred to as "Goss orientation" hereinafter) through secondary recrystallization annealing exhibits superior magnetic properties (see, e.g. JP-B 40-015644). There have been mainly employed in this regard, as indices of magnetic properties, magnetic flux density $B_8$ at magnetic field strength: 800 μm and iron loss (per kg) $W_{17/50}$ when a grain oriented electrical steel sheet has been magnetized to 1.7 T in an alternating magnetic field of excitation frequency: 50 Hz.

One of the means for reducing iron loss in a grain oriented electrical steel sheet is making orientations of crystal grains thereof after secondary recrystallization annealing be highly accumulated in Goss orientation. It is important, in order to make crystal orientations of a steel sheet after secondary recrystallization annealing be highly accumulated in Goss orientation, to form in advance predetermined microstructure in texture of the steel sheet subjected to primary recrystallization annealing so that only sharply Goss-orientated grains preferentially grow during secondary recrystallization annealing. Known examples of the predetermined microstructure which allows only sharply Goss-orientated grains to preferentially grow during secondary recrystallization annealing include {111}<112> orientation (which orientation will be referred to as "M orientation" hereinafter) and {12 4 1}<014> orientation (which orientation will be referred to as "S orientation" hereinafter). It is possible to make crystal grains after secondary recrystallization annealing be highly accumulated in Goss orientation (crystal grains in such an orientation state will be referred to as "Goss-oriented grains" hereinafter) by making crystal grains in matrix of a steel sheet subjected to primary recrystallization annealing be highly accumulated in M orientation and/or S orientation.

For example, JP-A 2001-060505 discloses that a steel sheet stably exhibiting superior magnetic properties after being subjected to secondary recrystallization annealing can be obtained when the steel sheet subjected to primary recrystallization annealing possesses: a texture in the vicinity of a surface layer of the steel sheet, having a maximum orientation within 10° from either the orientation of ($\phi1=0°$, $\Phi=15°$, and $\phi2=0°$) or the orientation of ($\phi1=5°$, $\Phi=20°$, and $\phi2=70°$) in Bunge's Eulerian angle representation; and a texture of a central layer of the steel sheet, having a maximum orientation within 5° from the orientation of $\phi1=90°$, $\Phi=60°$, and $\Phi2=45°$ in Bunge's Eulerian angles representation.

Further, one of the means for controlling texture of a steel sheet observed after primary recrystallization annealing is controlling rolling reduction rate in the final cold rolling. For example, JP-B 4123653 discloses that a grain oriented electrical steel sheet stably exhibiting superior magnetic properties can be obtained by manufacturing a grain oriented electrical steel sheet according to a generally known cold rolling method but specifically setting rolling reduction rate in the final cold rolling in the range of 70% to 91% (inclusive of 70% and 91%).

Demand for grain oriented electrical steel sheets exhibiting low iron loss has been rapidly increasing in recent years as energy-saving awareness in public arises. "Inst. Elec. Engrs. 95[II]" (1948), p. 38, discloses that eddy-current loss as a deciding factor of iron loss becomes more unfavorable in proportion to the square of sheet thickness value. This means that iron loss can be significantly reduced by decreasing sheet thickness of a steel sheet. In other words, reducing iron loss of a grain oriented electrical steel sheet is compatible with making the steel sheet thin, i.e. stable production of a thin steel sheet. However, silicon steel for a grain oriented electrical steel sheet is susceptible to hot shortness due to a relatively high content of Si therein, thereby inevitably imposing restrictions on production of a thin grain oriented electrical steel sheet by hot rolling. In view of the situation described above, two-step cold rolling has been employed as a technique of setting rolling reduction rate in the final cold rolling in a preferred range as disclosed in JP-B 4123653.

There have been developed a number of techniques of forming primary recrystallization texture such that the texture allows only sharply Goss-oriented grains to preferentially grow when a grain oriented electrical steel sheet is manufactured according to the two-step cold rolling method. For example, JP-A 63-259024 discloses a method for controlling precipitation morphology of carbides prior to the final cold rolling by controlled cooling after intermediate annealing, such that superior texture is formed in a steel sheet subjected to primary recrystallization annealing.

DISCLOSURE OF THE INVENTION

Problems to be solved by the Invention

However, the inventors of the present invention discovered that the two-step cold rolling method disclosed in JP-A 63-259024 has a problem in that crystal orientations in texture of a steel sheet subjected to primary recrystallization annealing tend to be highly accumulated only in M orientation and thus crystal orientation intensity in S orientation of the texture is relatively weak, although crystal orientations are preferably highly accumulated in S orientation, as well as M orientation, with good balance between the two orientations.

The inventors of the present invention assume that such a problem as described above occurs because crystal grain size of a steel sheet prior to the final cold rolling is generally very small and M-oriented recrystallization nuclei-generating sites exist at boundaries of such crystal grains prior to cold rolling, whereby the finer crystal grain size tends to increase the number of sites where M-oriented recrystallization nuclei are generated.

It is known that recrystallized grain size of steel decreases due to increase in accumulated strain and introduction of non-uniform strain caused by rolling. That is, the more repeatedly rolling-recrystallization process is carried out, the smaller size of recrystallized grains is resulted. High-carbon silicon steel utilizing austenite-ferrite transformation for the purpose of improving microstructure thereof in a hot rolled state, in particular, is susceptible to introduction of excessive non-uniform strain during rolling and thus recrystallized grains thereof tend to be fine and non-uniform because high carbon steel has dual-phase (ferrite+pearlite) microstructure.

In this regard, for example, JP-B 2648424 discloses a technique of carrying out annealing of a hot rolled steel sheet in a non-recrystallization temperature region and subjecting the steel sheet thus annealed to carbide precipitation process in cooling, such that precipitation morphology of carbides prior to the final cold rolling is adequately controlled. However, the technique of JP-B 2648424 rather makes recrystallized grains finer because the technique aims at breaking {100} fiber-like structure mainly through accumulation of strains at relatively high density.

The inventors of the present invention made a keen study to solve the aforementioned problems and, as a result, discovered that it is possible to enhance intensity ratio of S orientation in texture of a steel sheet subjected to primary recrystallization and thus adequately control the texture of the steel sheet subjected to primary recrystallization by controlling grain size of a steel sheet prior to the final cold rolling (grain size at that stage has not attracted any attention in the prior art), or more specifically, by spheroidizing lamellar-like carbides precipitated in pearlite microstructure as the secondary phase of the steel sheet (spheroidization of carbides in pearlite microstructure) to decrease non-uniform strain in rolling and coarsen crystal grains prior to the final cold rolling.

The present invention has been contrived based on the aforementioned discoveries and an object thereof is to provide a method for manufacturing a grain oriented electrical steel sheet by two-step cold rolling, which method enables obtaining an austenite-ferrite transformation utilizing-type grain oriented electrical steel sheet exhibiting superior magnetic properties after secondary recrystallization by carrying out a predetermined thermal treatment prior to any one of cold rolling processes other than finish cold rolling.

Means for solving the Problem

Specifically, primary features of the present invention are as follows. (1) A method for manufacturing a grain oriented electrical steel sheet, comprising the steps of:

subjecting a steel slab having a composition containing by mass %, C: 0.020% to 0.15% (inclusive of 0.020% and 0.15%), Si: 2.5% to 7.0% (inclusive of 2.5% and 7.0%), Mn: 0.005% to 0.3% (inclusive of 0.005% and 0.3%), acid-soluble aluminum: 0.01% to 0.05% (inclusive of 0.01% and 0.05%), N: 0.002% to 0.012% (inclusive of 0.002% and 0.012%), at least one of S and Se by the total content thereof being 0.05% or less, and the balance as Fe and incidental impurities to heating and subsequent hot rolling to obtain a hot rolled steel sheet; subjecting the hot rolled steel sheet optionally to hot-band annealing and essentially to at least two cold rolling operations with intermediate annealing therebetween to obtain a cold rolled steel sheet having final sheet thickness; and subjecting the cold rolled steel sheet to primary recrystallization annealing and then secondary recrystallization annealing, wherein a thermal treatment is carried out, prior to any one of cold rolling operations other than final cold rolling, at temperature in the range of 500° C. to 750° C. (inclusive of 500° C. and 750° C.) for a period in the range of 10 minutes to 480 hours (inclusive of 10 minutes and 480 hours).

(2) The method for manufacturing a grain oriented electrical steel sheet of (1) above, wherein temperature-increasing rate between 500° C. and 700° C. in the primary recrystallization annealing is at least 50° C./second.

(3) The method for manufacturing a grain oriented electrical steel sheet of (1) or (2) above, further comprising subjecting the cold rolled steel sheet to magnetic domain refinement at a stage after the final cold rolling.

(4) The method for manufacturing a grain oriented electrical steel sheet of (3) above, wherein the magnetic domain refinement is carried out by irradiating the steel sheet subjected to the secondary recrystallization annealing with electron beam.

(5) The method for manufacturing a grain oriented electrical steel sheet of (3) above, wherein the magnetic domain refinement is carried out by irradiating the steel sheet subjected to the secondary recrystallization annealing with continuous-wave laser.

(6) The method for manufacturing a grain oriented electrical steel sheet of any of (1) to (5) above, wherein the steel slab further contains by mass % at least one element selected from Ni: 0.005% to 1.5% (inclusive of 0.005% and 1.5%), Sn: 0.005% to 0.50% (inclusive of 0.005% and 0.50%), Sb: 0.005% to 0.50% (inclusive of 0.005% and 0.50%), Cu: 0.005% to 1.5% (inclusive of 0.005% and 1.5%), and P: 0.005% to 0.50% (inclusive of 0.005% and 0.50%).

Effect of the Invention

According to the method for manufacturing a grain oriented electrical steel sheet of the present invention, it is possible, due to successful formation of texture having crystal orientations highly accumulated in Goss orientation in a steel sheet subjected to primary recrystallization annealing, to manufacture a grain oriented electrical steel sheet exhibiting more excellent magnetic properties after secondary recrystallization annealing than the conventional grain oriented electrical steel sheet. In particular, it is possible to achieve excellent iron loss properties after secondary recrystallization annealing, i.e. $W_{17/50}$: 0.85 W/kg or less, even in a very thin steel sheet having sheet thickness: 0.23 mm, which is difficult to attain by the prior art.

BEST EMBODIMENT FOR CARRYING OUT THE INVENTION

Figure 1:
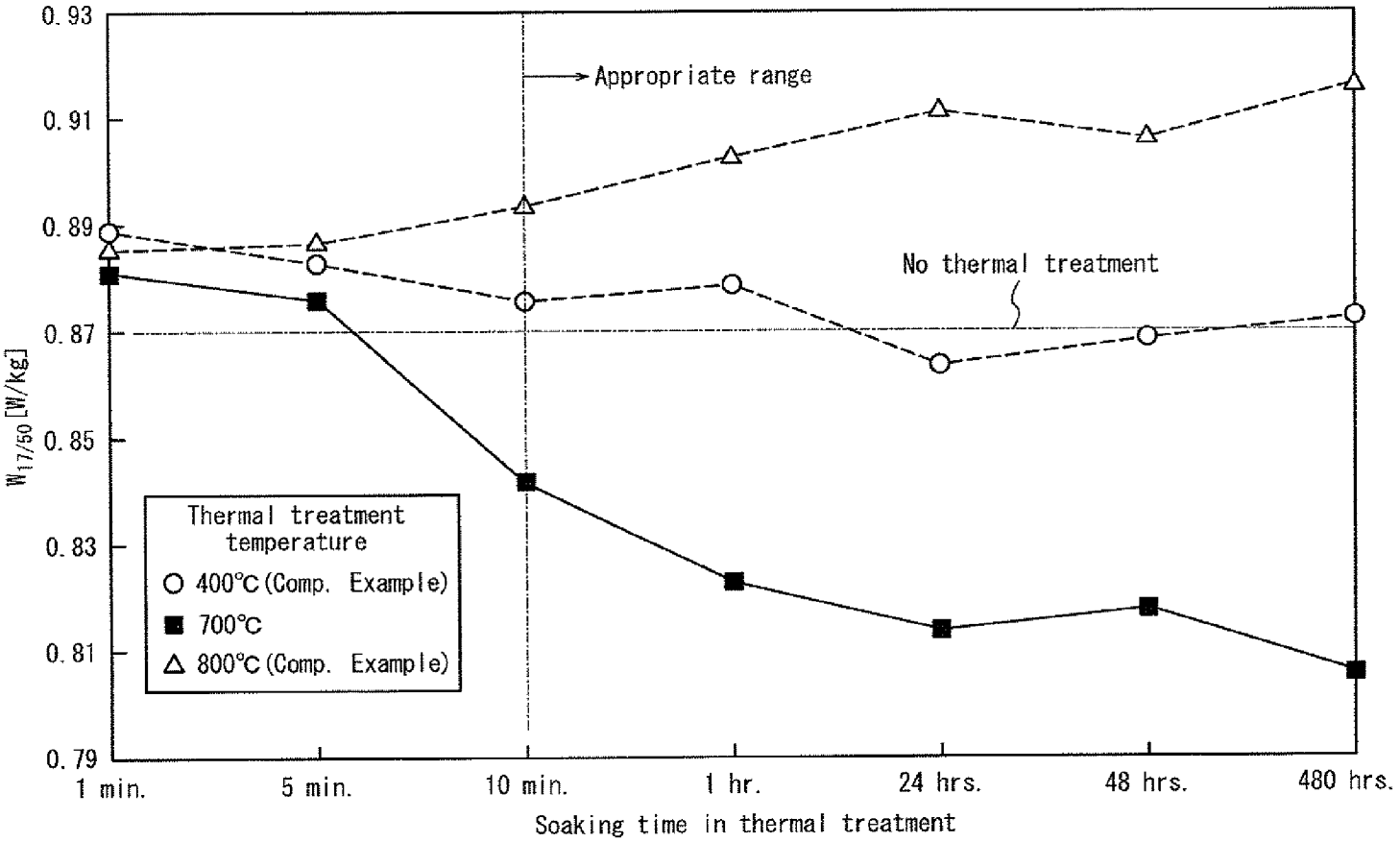
FIG. 1 is a graph showing relationships between soaking time and iron loss when a steel sheet is subjected to various types of thermal treatments.

The present invention will be described in detail hereinafter. The symbol "%" regarding a component of a steel sheet represents mass % in the present invention unless specified otherwise.

C: 0.020% to 0.15% (inclusive of 0.020% and 0.15%)

Carbon is an element necessitated in utilizing austenite-ferrite transformation when a steel sheet is hot rolled and a resulting hot rolled steel sheet is soaked in annealing to improve microstructure of the hot rolled steel sheet. Carbon content in steel exceeding 0.15% not only increases load experienced in decarburization but also results in incomplete decarburization, thereby possibly causing magnetic aging in a product steel sheet. However, carbon content in steel lower than 0.020% results in an insufficient effect of improving microstructure of a hot rolled steel sheet, thereby making it difficult to obtain desired primary recrystallization texture. Accordingly, carbon content in steel is to be in the range of 0.020% to 0.15% (inclusive of 0.020% and 0.15%).

Si: 2.5% to 7.0% (inclusive of 2.5% and 7.0%)

Silicon is a very effective element in terms of increasing electrical resistance of steel and decreasing eddy-current loss constituting a portion of iron loss. When Si is added to a steel sheet, electrical resistance monotonously increases until Si content in steel reaches 11% but formability of steel significantly deteriorates when Si content exceeds 7.0%. On the other hand, Si content in steel less than 2.5% lessens electrical resistance too much, thereby making it impossible to obtain good iron loss properties of the steel sheet. Accordingly, Si content in steel is to be in the range of 2.5% to 7.0% (inclusive of 2.5% and 7.0%). The preferable upper limit of Si content in steel is 4.0% in terms of stably ensuring good formability of the steel.

Mn: 0.005% to 0.3% (inclusive of 0.005% and 0.3%)

Manganese is an important element in a grain oriented electrical steel sheet because MnS and MnSe each serve as an inhibitor which suppresses normal grain growth in temperature-increasing process of secondary recrystallization annealing. Mn content in steel lower than 0.005% results in shortage of absolute quantity of the inhibitor and thus insufficient suppression of normal grain growth. However, Mn content in steel exceeding 0.3% not only necessitates heating a slab at relatively high temperature in slab-heating process prior to hot rolling to bring all manganese into the solute-Mn state but also allows coarse inhibitors to be precipitated, which results in insufficient suppression of normal grain growth after all. Accordingly, Mn content in steel is to be in the range of 0.005% to 0.3% (inclusive of 0.005% and 0.3%).

Acid-soluble aluminum: 0.01% to 0.05% (inclusive of 0.01% and 0.05%) Acid-soluble aluminum is an important element in a grain oriented electrical steel sheet because AlN serves as an inhibitor which suppresses normal grain growth in temperature-increasing process of secondary recrystallization annealing. Acid-soluble Al content in steel lower than 0.01% results in shortage of absolute quantity of the inhibitor and thus insufficient suppression of normal grain growth. However, acid-soluble Al content in steel exceeding 0.05% allows coarse AlN to be precipitated, which results in insufficient suppression of normal grain growth. Accordingly, acid-soluble Al content in steel is to be in the range of 0.01% to 0.05% (inclusive of 0.01% and 0.05%).

N: 0.002% to 0.012% (inclusive of 0.002% and 0.012%)

Nitrogen is bonded to aluminum to form an inhibitor. Nitrogen content in steel lower than 0.002% results in shortage of absolute quantity of the inhibitor and thus insufficient suppression of normal grain growth. However, nitrogen content in steel exceeding 0.012% causes voids (referred to "blisters") to be formed in a resulting steel sheet in cold rolling, which deteriorate appearance of the steel sheet. Accordingly, nitrogen content in steel is to be in the range of 0.002% to 0.012% (inclusive of 0.002% and 0.012%).

At least one of S and Se by the total content thereof being 0.05% or less Sulfur and selenium are each bonded to Mn to form an inhibitor. The total content of S and Se in steel exceeding 0.05% results in insufficient removal of sulfur and selenium in secondary recrystallization annealing, which worsens iron loss. Accordingly, the total content of at least one element selected from S and Se is to be 0.05% or less. Presence of these two elements is not essential in the present invention. However, the lower limit of the total content of S and Se is preferably around 0.01% in terms of ensuring a good effect caused by addition of S and/or Se, although there is no particular restriction on the lower limit.

The balance other than the aforementioned basic components of the grain oriented steel sheet of the present invention is Fe and incidental impurities. Examples of the incidental impurities include impurities incidentally mixed from raw materials, manufacturing facilities, and the like into steel.

The grain oriented electrical steel sheet of the present invention may further contain, in addition to the basic components described above, following other elements in an appropriate manner according to need.

Ni: 0.005% to 1.5% (inclusive of 0.005% and 1.5%)

Nickel, which is an austenite-forming element, is useful in terms of utilizing austenite transformation to improve microstructure of a hot rolled steel sheet and thus magnetic properties of the steel sheet. Nickel content in steel lower than 0.005% results in an insufficient effect of improving magnetic properties of the steel. However, Ni content in steel exceeding 1.5% deteriorates formability of steel and thus sheet-feeding properties of steel sheet, and also makes secondary recrystallization unstable to deteriorate magnetic properties of the steel sheet. Accordingly, Ni content in steel is to be in the range of 0.005% to 1.5% (inclusive of 0.005% and 1.5%).

At least one type of element selected from Sn: 0.005% to 0.50% (inclusive of 0.005% and 0.50%), Sly 0.005% to 0.50% (inclusive of 0.005% and 0.50%), Cu: 0.005% to 1.5% (inclusive of 0.005% and 1.5%), and P: 0.005% to 0.50% (inclusive of 0.005% and 0.50%)

Sn, Sb, Cu and P are useful elements in terms of improving magnetic properties of a steel sheet. When contents of these elements in steel fail to reach the aforementioned respective lower limit values thereof, the effects of improving magnetic properties of a resulting steel sheet caused by these elements will be insufficient. However, contents of these elements in steel exceeding the aforementioned respective upper limit values thereof make secondary recrystallization unstable to deteriorate magnetic properties of a resulting the steel sheet. Accordingly, Sn content is to be in the range of 0.005% to 0.50% (inclusive of 0.005% and 0.50%), Sb content is to be in the range of 0.005% to 0.50% (inclusive of 0.005% and 0.50%), Cu content is to be in the range of 0.005% to 1.5% (inclusive of 0.005% and 1.5%), and P content is to be in the range of 0.005% to 0.50% (inclusive of 0.005% and 0.50%).

In general, decarburizing annealing is carried out either independently from primary recrystallization annealing or as primary recrystallization annealing; and purification annealing is carried out either independently from secondary recrystallization annealing or as secondary recrystallization annealing in a process of manufacturing a grain oriented electrical steel sheet. As a result of these decarburizing annealing and purification annealing, contents of C, N and at least one element selected from S and Se are reduced. Therefore, a composition of steel sheet when tension-imparting coating film provided on a surface of the steel sheet is removed after purification annealing becomes as shown below.

C: 0.0035% or less, N: 0.0035% or less, and the total content of at least one element selected from S and Se: 0.0020% or less.

A steel slab having the aforementioned composition thus obtained is heated and hot rolled to obtain a hot rolled steel sheet. The hot rolled steel sheet is then optionally subjected to hot-band annealing to improve microstructure of the hot rolled steel sheet as desired (in a case where non-recrystallized portion in microstructure is to be eliminated to improve magnetic properties, for example). The hot-band annealing is preferably carried out under conditions of soaking temperature: 800° C. to 1200° C. (inclusive of 800° C. and 1200° C.) and soaking time: 2 seconds to 300 seconds (inclusive of 2 seconds and 300 seconds).

Soaking temperature in hot-band annealing lower than 800° C. fails to satisfactorily improve microstructure of a hot rolled steel sheet and allows non-recrystallized portion to remain in the microstructure, thereby possibly making it impossible to obtain desired microstructure. However, the soaking temperature is preferably 1200° C. or lower at which remelting and Ostwald growth of AlN, MnSe and MnS as inhibitors do not rapidly proceed, to ensure satisfactory secondary recrystallization performance. Accordingly, soaking temperature in hot-band annealing is preferably in the range of 800° C. to 1200° C. (inclusive of 800° C. and 1200° C.).

Soaking time shorter than 2 seconds in hot-band annealing results in too short retention time at high temperature, thereby possibly allowing non-recrystallized portion to remain and making it impossible to obtain the desired microstructure. However, the soaking time is preferably 300 seconds or less in which remelting and Ostwald growth of AlN, MnSe and MnS as inhibitors do not rapidly proceed, to ensure satisfactory secondary recrystallization performance. Accordingly, soaking time in hot-band annealing is preferably in the range of 2 seconds to 300 seconds (inclusive of 2 seconds and 300 seconds). The hot-band annealing described above is preferably carried out according to a generally-implemented continuous annealing method.

The grain oriented electrical steel sheet of the present invention can be obtained basically by subjecting the aforementioned hot rolled steel sheet optionally to hot-band annealing and essentially to at least two cold rolling operations with intermediate annealing therebetween to obtain a cold rolled steel sheet having final sheet thickness.

The most important feature of the present invention, however, resides in that a thermal treatment is carried out, prior to any one of cold rolling operations other than final cold rolling, at temperature in the range of 500° C. to 750° C. (inclusive of 500° C. and 750° C.) for a period ranging from 10 minutes to 480 hours (inclusive of 10 minutes and 480 hours).

An experiment was carried out to confirm an appropriate range of soaking time when the thermal treatment is implemented according to the present invention. The experiment included: heating a slab having a chemical composition of the present invention at 1350° C.; hot rolling the slab to sheet thickness of 2.2 mm to obtain a hot rolled steel sheet; subjecting the hot rolled steel sheet to hot-band annealing at 1050° C. for 40 seconds; then, prior to first cold rolling, subjecting the steel sheet to a thermal treatment in dry nitrogen atmosphere under the conditions shown in FIG. 1; subjecting the steel sheet thus treated to cold rolling to sheet thickness of 1.5 mm and intermediate annealing at 1080° C. for 80 seconds; then subjecting the steel sheet to another cold rolling to sheet thickness of 0.23 mm and primary recrystallization annealing also serving as decarburizing annealing at 800° C. for 120 seconds; coating a surface of the steel sheet with annealing separator mainly composed of MgO; and subjecting the steel sheet to secondary recrystallization annealing also serving as purification annealing at 1150° C. for 50 hours, to obtain test specimens under respective conditions. FIG. 1 shows the measurement results of magnetic properties of the respective test specimens.

The test specimen prepared at soaking temperature in the thermal treatment prior to the first cold rolling: 700° C. generally achieved successful reduction of iron loss but failed to improve iron loss properties when soaking time was less than 10 minutes. Iron loss properties failed to improve when soaking time was less than 10 minutes because then spheroidization of carbides in pearlite microstructure of a steel sheet did not proceed and non-uniform strains were excessively accumulated in the steel sheet in the first cold rolling, whereby grain size of the steel sheet at the stage of the intermediated annealing, i.e. grain size of the steel sheet prior to the final cold rolling, failed to grow large or be coarsened.

On the other hand, as shown in FIG. 1, the test specimen prepared at soaking temperature in the thermal treatment prior to the first cold rolling: 400° C. substantially failed to improve iron loss properties. Iron loss properties failed to improve in this test specimen because then spheroidization of carbides in pearlite microstructure of the steel sheet of the specimen did not proceed and non-uniform strains were excessively accumulated in the steel sheet in the first cold rolling, whereby grain size of the steel sheet at the stage of the intermediated annealing, i.e. grain size of the steel sheet prior to the final cold rolling, failed to grow large or be coarsened.

Further, as shown in FIG. 1, the test specimen prepared at soaking temperature in the thermal treatment prior to the first cold rolling: 800° C. utterly failed to improve iron loss properties. Iron loss properties failed to improve in this test specimen because the soaking temperature exceeding the $A_1$ transformation temperature caused a portion of pearlite phase to be transformed into austenite phase and diffusion of carbon stopped in the steel sheet of the specimen, whereby pearlite phase appeared again in cooling process, non-uniform strains were excessively accumulated in the steel sheet in the first cold rolling, and thus grain size of the steel sheet at the stage of the intermediated annealing, i.e. grain size of the steel sheet prior to the final cold rolling, failed to grow large or be coarsened.

That is, it has been revealed that: it is possible to coarsen grain size of a steel sheet at the stage of the intermediated annealing, i.e. prior to the final cold rolling, and obtain the desired primary recrystallization texture of the steel sheet by subjecting the steel sheet to a thermal treatment prior to first cold rolling under conditions of e.g. soaking temperature: 700° C. and soaking time: at least 10 minutes; and the steel sheet thus obtained exhibits superior magnetic properties.

Next, another experiment was carried out to confirm an appropriate range of soaking time when the thermal treatment is implemented according to the present invention.

Figure 2:
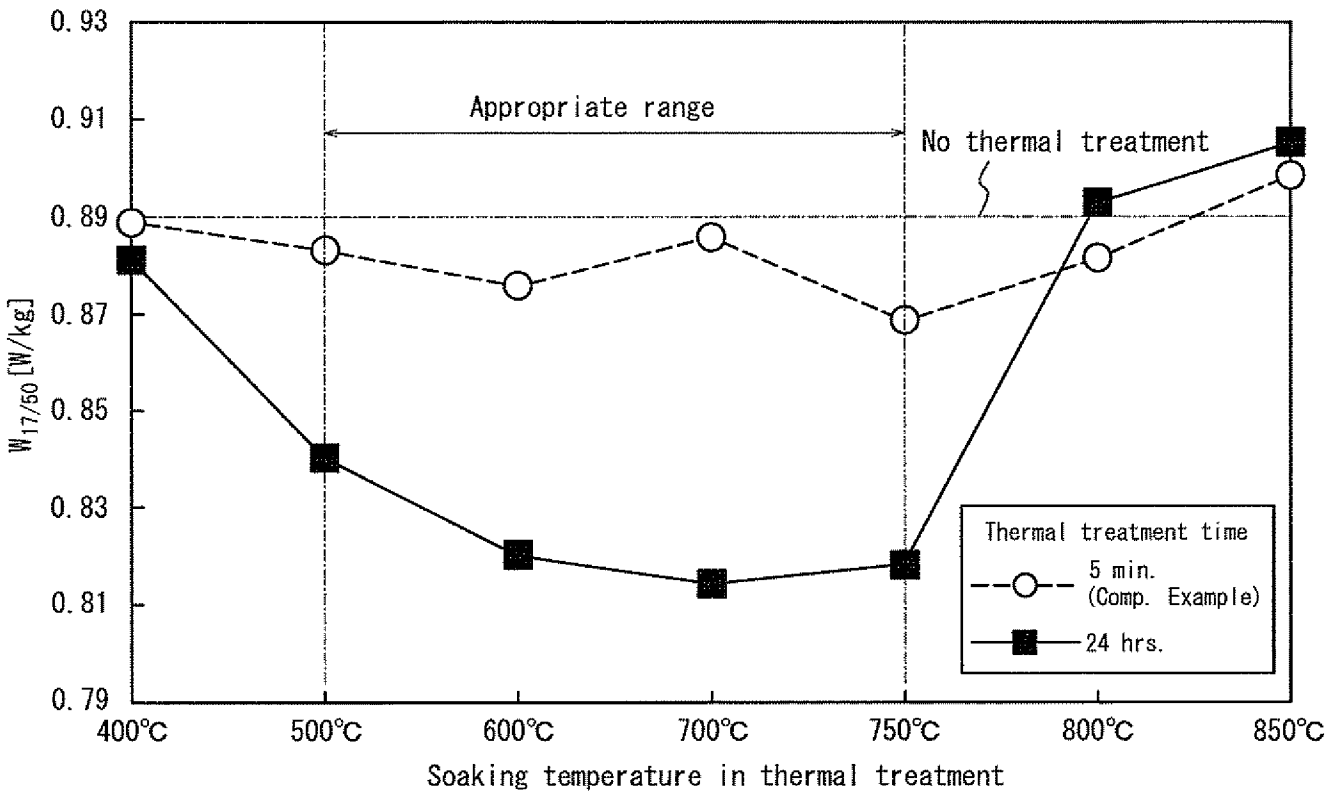
FIG. 2 is a graph showing relationships between soaking temperature and iron loss when a steel sheet is subjected to various types of thermal treatments.

The experiment included: heating a slab having a chemical composition of the present invention at 1350° C.; hot rolling the slab to sheet thickness of 2.0 mm to obtain a hot rolled steel sheet; subjecting the hot rolled steel sheet to hot-band annealing at 1000° C. for 40 seconds; then, prior to first cold rolling, subjecting the steel sheet to a thermal treatment in dry nitrogen atmosphere under the conditions shown in FIG. 2; subjecting the steel sheet thus treated to cold rolling to sheet thickness of 1.3 mm and intermediate annealing at 1100° C. for 80 seconds; then subjecting the steel sheet to another cold rolling to sheet thickness of 0.23 mm and primary recrystallization annealing also serving as decarburizing annealing at 800° C. for 120 seconds; coating a surface of the steel sheet with annealing separator mainly composed of MgO; and subjecting the steel sheet to secondary recrystallization annealing also serving as purification annealing at 1150° C. for 50 hours, to obtain test specimens under respective conditions. FIG. 2 shows the measurement results of magnetic properties of the respective test specimens.

It is understood from FIG. 2 that the test specimen with soaking time in the thermal treatment prior to the first cold rolling: 24 hours successfully improved iron loss properties of the steel sheet at soaking temperature in the range of 500° C. to 750° C. (inclusive of 500° C. and 750° C.). Specifically, in a case where soaking temperature is set to be in the range of 500° C. to 750° C. (inclusive of 500° C. and 750° C.), setting sufficient soaking time (e.g. 24 hours) ensures that spheroidization of lamella-like carbides (cementite) in pearlite microstructure of the steel sheet proceeds sufficiently and solute carbon in grains are diffused to grain boundaries to be precipitated as coarse spherical carbides (cementite) at grain boundaries. As a result, the steel sheet has microstructure resembling ferrite single phase, successfully reduces quantity of non-uniform strain generated during rolling and coarsens grain size of the steel sheet at the stage of the intermediated annealing, i.e. grain size of the steel sheet prior to the final cold rolling, whereby desired primary recrystallization texture can be obtained in the steel sheet.

On the other hand, the test specimen with soaking time in the thermal treatment prior to the first cold rolling: 5 minutes failed to cause an iron-loss improving effect even when the thermal treatment was carried out in the preferred temperature range shown in FIG. 2. It is understood from this result that the thermal treatment of the present invention requires a certain length of time to ensure spheroidization of lamellar-like carbides in pearlite microstructure and diffusion of intragranular solute carbon to grain boundaries to be precipitated as spherical carbides as described above.

In short, it has been revealed that: it is possible to coarsen grain size of a steel sheet at the stage of the intermediated annealing, i.e. grain size of the steel sheet prior to the final cold rolling, and obtain the desired primary recrystallization texture of the steel sheet by subjecting the steel sheet to a thermal treatment prior to first cold rolling under conditions of, e.g. soaking temperature: 500° C. to 750° C. (inclusive of 500° C. and 750° C.) and soaking time: e.g. 24 hours.

Further, yet another experiment was carried out to confirm the aforementioned appropriate ranges of soaking temperature and soaking time in the thermal treatment.

The experiment first carried out: preparing a slab containing C: 0.04%, Si: 3.1%, Mn: 0.13%, acid-soluble Al: 0.01%, N: 0.007%, S: 0.003%, Se: 0.03%, and the balance as Fe and incidental impurities; heating the slab at 1350° C.; and hot rolling the slab to sheet thickness of 2.0 mm to obtain a hot rolled steel sheet.

Figure 3:
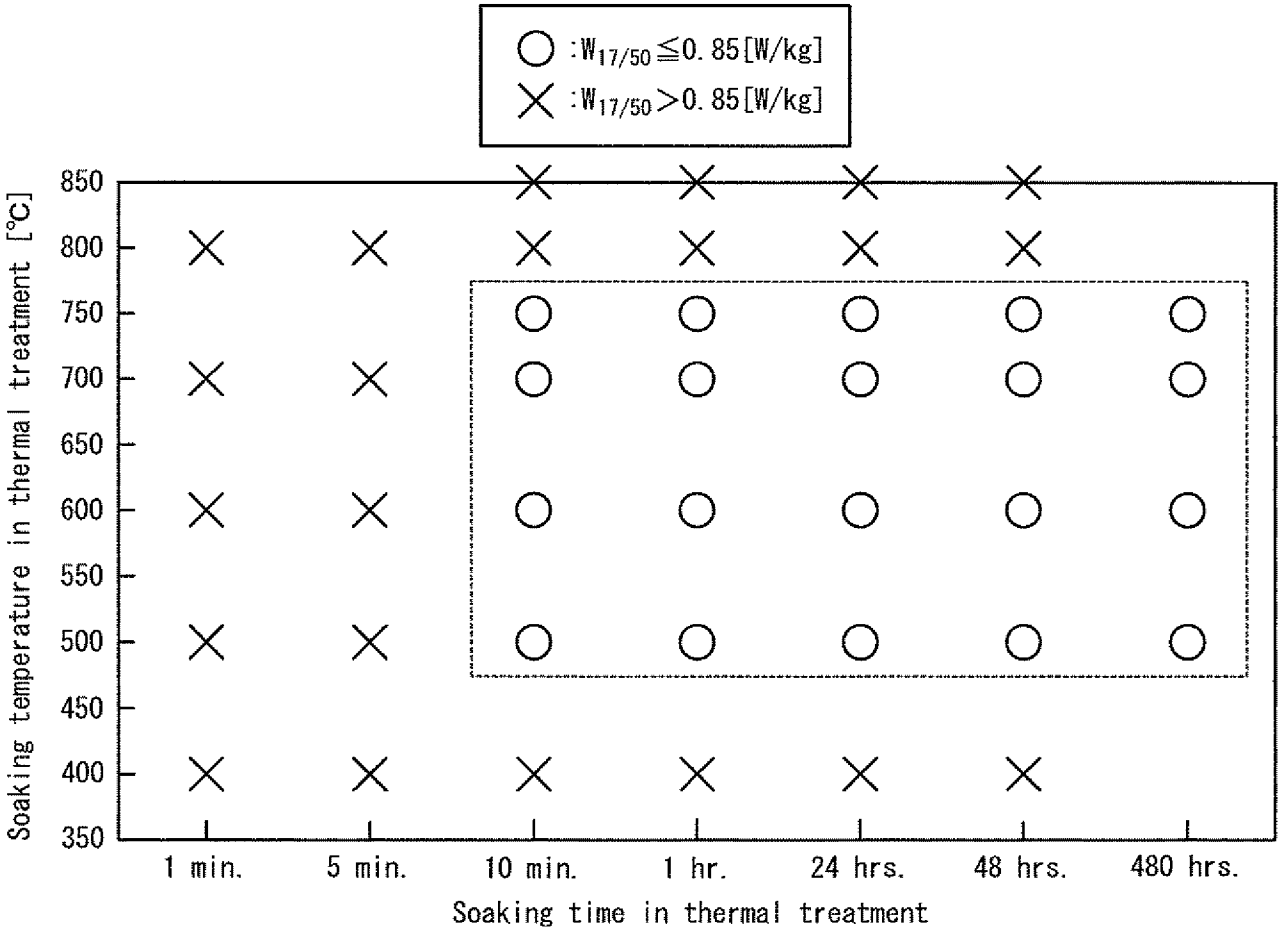
FIG. 3 is a graph showing relationships between soaking time, soaking temperature and iron loss in various types of thermal treatments.

The experiment further included: subjecting the hot rolled steel sheet to hot-band annealing at 1000° C. for 40 seconds; then, prior to first cold rolling, subjecting the steel sheet to a thermal treatment in dry nitrogen atmosphere (the soaking temperature and soaking time conditions were varied as shown in FIG. 3); subjecting the steel sheet thus treated to cooling in a furnace, cold rolling to sheet thickness of 1.5 mm and intermediate annealing at 1080° C. for 80 seconds; then subjecting the steel sheet to another cold rolling to sheet thickness of 0.23 mm and primary recrystallization annealing also serving as decarburizing annealing at 800° C. for 120 seconds; coating a surface of the steel sheet with annealing separator mainly composed of MgO; and subjecting the steel sheet to secondary recrystallization annealing also serving as purification annealing at 1150° C. for 50 hours, to obtain grain oriented electrical steel sheet samples. FIG. 3 shows the measurement results of iron loss value $W_{17/50}$ of the grain oriented electrical steel sheet samples in connection with the relationship between soaking temperature and soaking time in the thermal treatment prior to the first cold rolling.

It is understood from FIG. 3 that it is possible to obtain superior iron loss value, i.e. iron loss value $W_{17150}$ of a steel sheet after secondary recrystallization annealing≤0.85 W/kg, by carrying out the thermal treatment prior to the first cold rolling under the conditions of soaking temperature: 500° C. to 750° C. (inclusive of 500° C. and 750° C.) and soaking time: at least 10 minutes. Further, regarding the soaking time, it is confirmed from FIG. 3 that superior iron loss values are realized up to 480 hours. Accordingly, the upper limit of soaking time is to be 480 hours in view of productivity, production cost, and the like in the present invention.

The grain oriented electrical steel sheet samples prepared under the aforementioned appropriate conditions to exhibit satisfactorily low iron loss also show superior magnetic flux density $B_8$ values after secondary recrystallization annealing, respectively. Therefore, it is assumed that degree of accumulation of Goss-oriented grains is enhanced in a steel sheet after secondary recrystallization by carrying out the thermal treatment described above.

It is understood from the experiments shown in FIGS. 1 to 3 that a steel sheet having a chemical composition of the present invention, subjected to a predetermined thermal treatment, exhibits iron loss value after secondary recrystallization ≤0.85 W/kg, i.e. superior iron loss value.

Further, it is understood that the thermal treatment needs to be carried out, prior to any one of cold rolling operations other than the final cold rolling, at temperature in the range of 500° C. to 750° C. (inclusive of 500° C. and 750° C.) for a period in the range of 10 minutes to 480 hours (inclusive of 10 minutes and 480 hours).

It has been confirmed that, although the foregoing experiments are unanimously related to the thermal treatment prior to the first cold rolling, a magnetic properties-improving effect equivalent to those observed in the foregoing experiments can be caused as long as the thermal treatment is carried out prior to any one of cold rolling operations other than the final cold rolling. The thermal treatment described above is preferably carried out as batch annealing in terms of ensuring the aforementioned appropriate processing or retention time.

Conventional conditions relating to the intermediate annealing may by applied to the present invention. Preferable conditions of the intermediate annealing include soaking temperature: 800° C. to 1200° C. (inclusive of 800° C. and 1200° C.), soaking time: 2 seconds to 300 seconds (inclusive of 2 seconds and 300 seconds), and cooling rate between 800° C. to 400° C. in the cooling process after the intermediate annealing: 10° C./second to 200° C./second (inclusive of 10° C./second and 200° C./second) (for rapid cooling). These conditions are suitable for the intermediate annealing prior to the final cold rolling in particular.

Specifically, soaking temperature in the intermediate annealing is preferably 800° C. or higher in terms of ensuring sufficient recrystallization of cold-rolled microstructure to improve evenness of grain size in the microstructure of a steel sheet after primary crystallization and thus facilitate grain growth in secondary recrystallization in the microstructure. However, the soaking temperature is preferably 1200° C. or lower at which remelting and Ostwald growth of AlN, MnSe and MnS as inhibitors do not rapidly proceed, to ensure satisfactory secondary recrystallization performance.

Accordingly, soaking temperature in the intermediate annealing is preferably in the range of 800° C. to 1200° C. (inclusive of 800° C. and 1200° C.).

Further, soaking time in the intermediate annealing is preferably at least 2 seconds in terms of ensuring sufficient recrystallization of cold-rolled microstructure of a steel sheet. However, to ensure satisfactory secondary recrystallization performance, the soaking time is preferably 300 seconds or less so that remelting and Ostwald growth of AlN, MnSe and MnS as inhibitors do not rapidly proceed.

Accordingly, soaking temperature in the intermediate annealing is preferably in the range of 2 seconds to 300 seconds (inclusive of 2 seconds and 300 seconds).

Yet further, setting cooling rate between 800° C. to 400° C. in the cooling process after the intermediate annealing to be at least 10° C./second is preferable in terms of suppressing coarsening of carbides and further enhancing the effect of improving texture of a steel sheet in a period ranging from the final cold rolling and primary recrystallization annealing.

However, setting the cooling rate between 800° C. to 400° C. in the cooling process after the intermediate annealing to be 200° C./second or lower is preferable in terms of preventing hard martensite phase from being formed in microstructure of a steel sheet and improving the microstructure of the steel sheet after primary recrystallization to further improve magnetic properties of the steel sheet. Accordingly, the cooling rate between 800° C. to 400° C. in the cooling process after the intermediate annealing is preferably in the range of 10° C./second to 200° C./second (inclusive of 10° C./second and 200° C./second). The intermediate annealing described above is preferably carried out according to a generally-implemented continuous annealing method.

Rolling reduction rate in the final cold rolling is preferably in the range of 60% to 92% (inclusive of 60% and 92%) in terms of ensuring satisfactory texture of a steel sheet after primary recrystallization in the present invention, although the rolling reduction rate is not particularly restricted.

The steel sheet rolled to have the final sheet thickness by the final cold rolling is then preferably subjected to primary recrystallization annealing at soaking temperature: 700° C. to 1000° C. (inclusive of 700° C. and 1000° C.). Primary recrystallization annealing, carried out in, e.g. a wet hydrogen atmosphere, can perform decarburization of the steel sheet, as well.

Setting soaking temperature in the primary recrystallization annealing to be 700° C. or higher is preferable in terms of ensuring sufficient recrystallization of cold-rolled microstructure of the steel sheet. However, the soaking temperature is preferably 1000° C. or lower in terms of suppressing secondary recrystallization of Goss-oriented grains at this stage. Accordingly, soaking temperature in the primary recrystallization annealing is preferably in the range of 700° C. to 1000° C. (inclusive of 700° C. and 1000° C.).

Carrying out primary recrystallization annealing such that it satisfies the aforementioned soaking conditions is preferable in order to obtain such a texture-improving effect as described above. However, a temperature-increasing stage of the primary recrystallization annealing is more important in terms of highly accumulating crystal orientations in S orientation. Specifically, it is possible to further enhance intensity ratios of S orientation and Goss orientation in texture of a steel sheet after primary recrystallization and make grain size after secondary recrystallization fine while increasing magnetic flux density of the steel sheet after secondary recrystallization, thereby eventually improving iron loss properties of the steel sheet, by carrying out the primary recrystallization annealing at temperature-increasing rate of at least 50° C./second between 500° C. and 700° C.

The present invention relates to a technique of coarsening grain size prior to the final cold rolling of a steel sheet by subjecting the steel sheet to a predetermined thermal treatment prior to any of cold rolling operations other than the final cold rolling, so that intensity ratio of S orientation in texture of the steel sheet after primary recrystallization is increased. Setting temperature-increasing rate between 500° C. and 700° C. in the temperature-increasing process of the primary recrystallization annealing, to be at least 50° C./second, successfully decreases intensity ratio of M orientation slightly and increase intensity ratios of S orientation and Goss orientation in texture of the steel sheet after primary recrystallization. That is, intensity ratio of S orientation, which orientation facilitates high accumulation of sharply Goss-oriented grains in secondary recrystallization, and intensity ratio of Goss orientation which serves as a nucleus of secondary recrystallization are both increased, whereby a resulting final steel sheet product can maintain high magnetic flux density and achieve low iron loss due to fine grains resulted from secondary recrystallization.

Regarding a temperature section in which the temperature-increasing rate is to be controlled, the temperature-increasing rate in a section ranging from 500° C. to 700° C., which section corresponds to recovery of microstructure, is critical because rapid heating in a temperature range corresponding to recovery of microstructure after cold rolling to promote recrystallization must be achieved. The temperature-increasing rate is preferably at least 50° C./second because the temperature-increasing rate lower than 50° C./second cannot sufficiently suppress recovery of microstructure in the aforementioned temperature range. There is no particular restriction on the upper limit of the temperature-increasing rate. However, the temperature-increasing rate is preferably 400° C./second or less because too high temperature-increasing rate requires large-scale facilities and the like.

Primary recrystallization annealing, also serving as decarburization process in many applications, is preferably carried out in an oxidizing atmosphere (e.g. $P_{H2O}/P_{H2}>0.1$) which is advantageous to decarburization. However, an atmosphere not satisfying the aforementioned range (i.e. $P_{H2O}/P_{H2}\leq 0.1$) is allowed in the temperature section between 500° C. and 700° C. in which relatively high temperature-increasing rate is required and introduction of an oxidizing atmosphere into facilities may be difficult due to restrictions resulting from this requirement. That is, feeding the sufficiently oxidizing atmosphere in a temperature range around 800° C. is important in terms of good decarburization. It is acceptable to carry out decarburization annealing separately from primary recrystallization annealing.

Further, it is acceptable to carry out nitriding treatment of incorporating nitrogen into steel by concentration of 150 ppm to 250 ppm in a period between primary recrystallization annealing and secondary recrystallization annealing. The known techniques such as carrying out thermal treatment in $NH_3$ atmosphere after primary recrystallization, adding nitride into annealing separator, feeding a nitriding atmosphere as a secondary recrystallization annealing atmosphere, or the like may be applied to the nitriding treatment.

Thereafter, a surface of the steel sheet is optionally coated with annealing separator mainly composed of MgO and then secondary recrystallization is carried out. There are no particular restrictions on annealing conditions of the secondary recrystallization annealing and the conventionally known annealing conditions can be applied thereto. Secondary recrystallization annealing can serve as purification annealing, as well, by setting the annealing atmosphere thereof to be a hydrogen atmosphere. The steel sheet thus treated is then further subjected to insulating coating-application process and flattening annealing, whereby the desired grain oriented electrical steel sheet is obtained. There are no particularly restrictions on manufacturing conditions in the insulating coating-application process and flattening annealing and the conventional methods can be applied thereto.

The grain oriented electrical steel sheet manufactured by the aforementioned manufacturing processes has very high magnetic flux density after secondary recrystallization, together with superior iron loss properties. Having high magnetic flux density (for a grain oriented electrical steel sheet) means that only crystal grains having orientations very close to Goss orientations have preferentially grown in the secondary recrystallization process of the steel sheet. It is known that the closer the orientations of crystal grains to Goss orientation, the more rapidly secondary recrystallization grains grow. That is, having high magnetic flux density indicates potential increase in size or coarsening of secondary recrystallized grains, which is not advantageous in terms of decreasing eddy-current loss but advantageous in terms of reducing hysteresis loss.

Accordingly, it is preferable to carry out magnetic domain refinement in order to address the problematic phenomenon described above contradictory to the final object of the present invention, i.e. reduction of iron loss, and enhance the effect of reducing iron loss of the invention. Carrying out adequate magnetic domain refinement in the present invention successfully decreases the disadvantageous eddy-current loss caused by coarsening of secondary recrystallized grains, thereby, together with the hysteresis loss-reducing effect as the main effect of the present invention, synergistically further reducing iron loss.

Any known heat-proof or non-heat-proof magnetic domain refinement processes are applicable at a stage after the final cold rolling in the present invention. Irradiating a steel sheet surface after secondary recrystallization with electron beam or continuous-wave laser ensures that a magnetic domain refining effect reaches the inner portion in sheet thickness direction of the steel sheet, whereby a very low iron loss value can be obtained as compared with other magnetic domain refinement processes by, e.g. etching.

EXAMPLES

Experiment 1

Experiment 1 was carried out by: preparing a slab containing C: 0.06%, Si: 3.2%, Mn: 0.12%, acid-soluble Al: 0.01%, N: 0.005%, S: 0.0030%, Se: 0.03%, and the balance as Fe and incidental impurities; heating the slab at 1350° C.; and hot rolling the slab to sheet thickness of 2.2 mm to obtain a hot rolled steel sheet; subjecting the hot rolled steel sheet to hot-band annealing at 1050° C. for 40 seconds; then, prior to first cold rolling, subjecting the steel sheet to a thermal treatment in dry nitrogen atmosphere under conditions as shown in Table 1; subjecting the steel sheet thus treated to cold rolling to sheet thickness of 1.5 mm and intermediate annealing at 1080° C. for 80 seconds; then subjecting the steel sheet to another cold rolling to sheet thickness of 0.23 mm and primary recrystallization annealing also serving as decarburizing annealing at 800° C. for 120 seconds, with setting the temperature-increasing rate between 500° C. and 700° C. in the primary recrystallization annealing to be 20° C./second; coating a surface of the steel sheet with annealing separator mainly composed of MgO; and subjecting the steel sheet to secondary recrystallization annealing also serving as purification annealing at 1150° C. for 50 hours, to obtain grain oriented electrical steel sheet samples. Table 1 shows the measurement results of iron loss of these steel sheet samples.

TABLE 1

| No. | Soaking temperature (° C.) | Soaking time | $W_{17/50}$ [W/kg] | Note |
|---|---|---|---|---|
| 1 | 400 | 1 min. | 0.889 | Comp. Example |
| 2 | 400 | 5 min. | 0.883 | Comp. Example |
| 3 | 400 | 10 min. | 0.876 | Comp. Example |
| 4 | 400 | 1 hr. | 0.879 | Comp. Example |
| 5 | 400 | 24 hrs. | 0.864 | Comp. Example |
| 6 | 400 | 48 hrs. | 0.869 | Comp. Example |
| 7 | 400 | 480 hrs. | 0.873 | Comp. Example |
| 8 | 700 | 1 min. | 0.881 | Comp. Example |
| 9 | 700 | 5 min. | 0.876 | Comp. Example |
| 10 | 700 | 10 min. | 0.842 | Example |

TABLE 1-continued

| No. | Soaking temperature (° C.) | Soaking time | $W_{17/50}$ [W/kg] | Note |
|---|---|---|---|---|
| 11 | 700 | 1 hr. | 0.823 | Example |
| 12 | 700 | 24 hrs. | 0.814 | Example |
| 13 | 700 | 48 hrs. | 0.818 | Example |
| 14 | 700 | 480 hrs. | 0.806 | Example |
| 15 | 800 | 1 min. | 0.886 | Comp. Example |
| 16 | 800 | 5 min. | 0.887 | Comp. Example |
| 17 | 800 | 10 min. | 0.894 | Comp. Example. |
| 18 | 800 | 1 hr. | 0.903 | Comp. Example |
| 19 | 800 | 24 hrs. | 0.912 | Comp. Example |
| 20 | 800 | 48 hrs. | 0.907 | Comp. Example |
| 21 | 800 | 480 hrs. | 0.917 | Comp. Example |

"Example" represents Example according to the present invention.

It is understood from Table 1 that a grain oriented electrical steel sheet having superior magnetic properties can be obtained by carrying out a thermal treatment prior to first cold rolling under conditions of soaking temperature: e.g. 700° C. and soaking time: at least 10 minutes.

Experiment 2

Experiment 2 was carried out by: preparing a slab containing C: 0.10%, Si: 3.4%, Mn: 0.10%, acid-soluble Al: 0.02%, N: 0.008%, S: 0.0030%, Se: 0.005%, and the balance as Fe and incidental impurities; heating the slab at 1350° C.; and hot rolling the slab to sheet thickness of 2.0 mm to obtain a hot rolled steel sheet; subjecting the hot rolled steel sheet to hot-band annealing at 1000° C. for 40 seconds; then, prior to first cold rolling, subjecting the steel sheet to a thermal treatment in dry nitrogen atmosphere under conditions as shown in Table 2; subjecting the steel sheet thus treated to cold rolling to sheet thickness of 1.3 mm and intermediate annealing at 1100° C. for 80 seconds; then subjecting the steel sheet to another cold rolling to sheet thickness of 0.23 mm and primary recrystallization annealing also serving as decarburizing annealing at 800° C. for 120 seconds, with setting the temperature-increasing rate between 500° C. and 700° C. in the primary recrystallization annealing to be 20° C./second; coating a surface of the steel sheet with annealing separator mainly composed of MgO; and subjecting the steel sheet to secondary recrystallization annealing also serving as purification annealing at 1150° C. for 50 hours, to obtain grain oriented electrical steel sheet samples. Table 2 shows the measurement results of iron loss of these steel sheet samples.

TABLE 2

| No. | Soaking temperature (° C.) | Soaking time | $W_{17/50}$ [W/kg] | Note |
|---|---|---|---|---|
| 1 | 400 | 5 min. | 0.889 | Comp. Example |
| 2 | 500 | 5 min. | 0.883 | Comp. Example |
| 3 | 600 | 5 min. | 0.876 | Comp. Example |
| 4 | 700 | 5 min. | 0.886 | Comp. Example |
| 5 | 750 | 5 min. | 0.869 | Comp. Example |
| 6 | 800 | 5 min. | 0.882 | Comp. Example |
| 7 | 850 | 5 min. | 0.899 | Comp. Example |
| 8 | 400 | 24 hrs. | 0.881 | Comp. Example |
| 9 | 500 | 24 hrs. | 0.844 | Example |
| 10 | 600 | 24 hrs. | 0.822 | Example |
| 11 | 700 | 24 hrs. | 0.814 | Example |
| 12 | 750 | 24 hrs. | 0.818 | Example |
| 13 | 800 | 24 hrs. | 0.894 | Comp. Example |
| 14 | 850 | 24 hrs. | 0.906 | Comp. Example |

It is understood from Table 2 that a grain oriented electrical steel sheet having superior magnetic properties can be obtained by carrying out a thermal treatment prior to first cold rolling under conditions of soaking temperature: 500° C.-750° C. and soaking time: e.g. 24 hours.

Experiment 3

Experiment 3 was carried out by: preparing a slab containing the respective components shown in FIG. 3 and essentially Si: 3.4%, N: 0.008%, S: 0.0030%, Se: 0.02%, and the balance as Fe and incidental impurities; heating the slab at 1350° C.; and hot rolling the slab to sheet thickness of 2.0 mm to obtain a hot rolled steel sheet; subjecting the hot rolled steel sheet to hot-band annealing at 1000° C. for 40 seconds; then, prior to first cold rolling, subjecting the steel sheet to a thermal treatment in dry nitrogen atmosphere under conditions of soaking temperature: 700° C. and soaking time: 24 hours; subjecting the steel sheet thus treated to cold rolling to sheet thickness of 1.3 mm and intermediate annealing at 1080° C. for 80 seconds; then subjecting the steel sheet to another cold rolling to sheet thickness of 0.23 mm and primary recrystallization annealing also serving as decarburizing annealing at 820° C. for 120 seconds, with setting the temperature-increasing rate between 500° C. and 700° C. in the primary recrystallization annealing to be 20° C./second; coating a surface of the steel sheet with annealing separator mainly composed of MgO; and subjecting the steel sheet to secondary recrystallization annealing also serving as purification annealing at 1150° C. for 50 hours, to obtain grain oriented electrical steel sheet samples. Table 3 shows the measurement results of magnetic properties of these steel sheet samples.

TABLE 3

| | Chemical composition [mass %] | | | | | | | | Magnetic properties | | |
|---|---|---|---|---|---|---|---|---|---|---|---|
| | | | | | | | | | $W_{17/50}$ | $B_8$ | |
| No. | C | Al | Mn | Ni | Sn | Sb | Cu | P | [W/kg] | [T] | Note |
| 1 | 0.005 | 0.02 | 0.1 | tr | tr | tr | tr | tr | 0.97 | 1.86 | Comp. Example |
| 2 | 0.02 | 0.02 | 0.1 | tr | tr | tr | tr | tr | 0.84 | 1.94 | Example |
| 3 | 0.08 | 0.02 | 0.1 | tr | tr | tr | tr | tr | 0.82 | 1.94 | Example |
| 4 | 0.15 | 0.02 | 0.1 | tr | tr | tr | tr | tr | 0.83 | 1.95 | Example |
| 5 | 0.20 | 0.02 | 0.1 | tr | tr | tr | tr | tr | 1.04 | 1.88 | Comp. Example |
| 6 | 0.05 | 0.01 | 0.1 | tr | tr | tr | tr | tr | 0.81 | 1.95 | Example |
| 7 | 0.05 | 0.05 | 0.1 | tr | tr | tr | tr | tr | 0.83 | 1.93 | Example |
| 8 | 0.05 | 0.02 | 0.005 | tr | tr | tr | tr | tr | 0.83 | 1.93 | Example |
| 9 | 0.05 | 0.02 | 0.3 | tr | tr | tr | tr | tr | 0.82 | 1.93 | Example |
| 10 | 0.05 | 0.02 | 0.1 | 0.005 | tr | tr | tr | tr | 0.83 | 1.94 | Example |
| 11 | 0.05 | 0.02 | 0.1 | 0.02 | tr | tr | tr | tr | 0.78 | 1.96 | Example |
| 12 | 0.05 | 0.02 | 0.1 | 1.5 | tr | tr | tr | tr | 0.80 | 1.95 | Example |
| 13 | 0.05 | 0.02 | 0.1 | tr | 0.005 | tr | tr | tr | 0.84 | 1.93 | Example |
| 14 | 0.05 | 0.02 | 0.1 | tr | 0.05 | tr | tr | tr | 0.77 | 1.95 | Example |
| 15 | 0.05 | 0.02 | 0.1 | tr | 0.5 | tr | tr | tr | 0.81 | 1.95 | Example |
| 16 | 0.05 | 0.02 | 0.1 | tr | tr | 0.005 | tr | tr | 0.84 | 1.93 | Example |
| 17 | 0.05 | 0.02 | 0.1 | tr | tr | 0.05 | tr | tr | 0.81 | 1.94 | Example |
| 18 | 0.05 | 0.02 | 0.1 | tr | tr | 0.5 | tr | tr | 0.80 | 1.95 | Example |
| 19 | 0.05 | 0.02 | 0.1 | tr | tr | tr | 0.005 | tr | 0.84 | 1.94 | Example |
| 20 | 0.05 | 0.02 | 0.1 | tr | tr | tr | 0.05 | tr | 0.81 | 1.94 | Example |
| 21 | 0.05 | 0.02 | 0.1 | tr | tr | tr | 1.5 | tr | 0.82 | 1.94 | Example |
| 22 | 0.05 | 0.02 | 0.1 | tr | tr | tr | tr | 0.005 | 0.84 | 1.93 | Example |
| 23 | 0.05 | 0.02 | 0.1 | tr | tr | tr | tr | 0.1 | 0.81 | 1.94 | Example |
| 24 | 0.05 | 0.02 | 0.1 | tr | tr | tr | tr | 0.5 | 0.80 | 1.94 | Example |

It is understood from Table 3 that samples Nos. 2-4 having the chemical compositions according to the present invention exhibited satisfactory magnetic properties among samples Nos. 1-5 in which only carbon content was changed.

Carbon content was kept constant at 0.05% and contents of Al, Mn, Ni, Sn, Sb, Cu and P were changed, respectively, in samples Nos. 6-24. The samples having the chemical compositions within the scope of the present invention, among samples Nos. 6-24, unanimously exhibited superior magnetic properties, as shown in FIG. 3.

In contrast, sample No. 1 and sample No. 5 having carbon contents out of the scope of the present invention exhibited poor magnetic properties, respectively, because: austenite-ferrite transformation failed to occur and the effect of improving texture of a steel sheet after primary recrystallization was weak in sample No. 1 having too low carbon content; and magnitude of non-uniform deformation in first cold rolling increased due to an increase in austenite phase fraction at high temperature to make grain size of the steel sheet at the stage of the intermediate annealing fine, whereby intensity ratio of M direction in microstructure of the steel sheet after primary recrystallization increased, and in addition, decarburization in first primary recrystallization annealing was incomplete, in sample No. 5 having too high carbon content.

Example 4

Example 4 was carried out by preparing grain oriented electrical steel sheet samples under the same conditions as those of sample No, 11 and sample No. 14 of Experiment 1 (each having the final sheet thickness of 0.23 mm after the final cold rolling), except that the temperature-increasing rate between 500° C. and 700° C. in primary recrystallization annealing and the magnetic domain refinement techniques were variously changed as shown in Table 4.

Specifically, magnetic domain refinement by etch grooves was carried out by forming, in the direction orthogonal to the rolling direction, grooves each having width: 150 μm, depth: 15 μm, interval in the rolling direction: 5 mm on one surface of a steel sheet sample cold rolled to sheet thickness of 0.23 mm.

Magnetic domain refinement by electron beam was carried out by continuous irradiation of one surface of a steel sheet sample after final annealing with electron beam in the direction orthogonal to the rolling direction under the conditions of accelerating voltage: 100 kV, irradiation interval: 5 mm, and beam current: 3 mA.

Magnetic domain refinement by laser was carried out by continuous irradiation of one surface of a steel sheet sample after final annealing with laser in the direction orthogonal to the rolling direction under the conditions of beam diameter: 0.3 mm, output: 200 W, scanning rate: 100 m/second, and irradiation interval: 5 mm.

Table 4 shows the measurement results of magnetic properties of the steel sheet samples.

TABLE 4

| | Thermal treatment prior to cold rolling | | Primary recrystallization annealing | | Magnetic properties (after magnetic domain refinement) | | |
|---|---|---|---|---|---|---|---|
| No. | Soaking temperature [° C.] | Soaking time | Temperature-increasing rate (500° C.-700° C.) [° C./s] | Magnetic domain refinement means | $W_{17/50}$ [W/kg] | $B_8$ [T] | Note |
| 1 | 700 | 1 hour | 20 | — | 0.823 | 1.948 | Example |
| 2 | | | | Etch groove | 0.714 | 1.911 | Example |
| 3 | | | | Electron beam irradiation | 0.698 | 1.946 | Example |
| 4 | | | | Laser irradiation | 0.696 | 1.947 | Example |
| 5 | | | 40 | — | 0.807 | 1.948 | Example |
| 6 | | | | Etch groove | 0.696 | 1.912 | Example |
| 7 | | | | Electron beam irradiation | 0.666 | 1.945 | Example |
| 8 | | | | Laser irradiation | 0.671 | 1.945 | Example |
| 9 | | | 100 | — | 0.752 | 1.951 | Example |
| 10 | | | | Etch groove | 0.639 | 1914 | Example |
| 11 | | | | Electron beam irradiation | 0.601 | 1.949 | Example |
| 12 | | | | Laser irradiation | 0.604 | 1.949 | Example |
| 13 | 700 | 480 hrs. | 20 | — | 0.806 | 1.948 | Example |
| 14 | | | | Etch groove | 0.704 | 1.912 | Example |
| 15 | | | | Electron beam irradiation | 0.684 | 1.946 | Example |
| 16 | | | | Laser irradiation | 0.685 | 1.946 | Example |
| 17 | | | 40 | — | 0.793 | 1.948 | Example |
| 18 | | | | Etch groove | 0.690 | 1.913 | Example |
| 19 | | | | Electron beam irradiation | 0.651 | 1.946 | Example |
| 20 | | | | Laser irradiation | 0.655 | 1.946 | Example |
| 21 | | | 100 | — | 0.738 | 1.951 | Example |
| 22 | | | | Etch groove | 0.631 | 1.915 | Example |
| 23 | | | | Electron beam irradiation | 0.594 | 1.949 | Example |
| 24 | | | | Laser irradiation | 0.597 | 1.948 | Example |

It is understood from Table 4 that samples subjected, after hot-band annealing and prior to first cold rolling, to a thermal treatment in thy nitrogen atmosphere within the scope of the present invention exhibit superior iron loss properties as the temperature-increasing rate between 500° C. and 700° C. in primary recrystallization increases. Further, it is understood from Table 4 that very good iron loss properties can be obtained at every temperature-increasing rate by further carrying out magnetic domain refinement process.

INDUSTRIAL APPLICABILITY

The grain oriented electrical steel sheet obtained by the manufacturing method of the present invention has better magnetic properties than the conventional grain oriented electrical sheet sheets. A higher-performance transformer or the like can be manufactured by using the grain oriented electrical steel sheet of the present invention.

The invention claimed is:

1. A method for manufacturing a grain oriented electrical steel sheet, comprising the steps of:

subjecting a steel slab to heating and subsequent hot rolling to obtain a hot rolled steel sheet, the steel slab having a composition containing by mass %, C: 0.020% to 0.15% (inclusive of 0.020% and 0.15%), Si: 2.5% to 7.0% (inclusive of 2.5% and 7.0%), Mn: 0.005% to 0.3% (inclusive of 0.005% and 0.3%), acid-soluble aluminum: 0.01% to 0.05% (inclusive of 0.01% and 0.05%), N: 0.002% to 0.012% (inclusive of 0.002% and 0.012%), at least one of S and Se by the total content thereof being 0.05% or less, and the balance as Fe and incidental impurities;

subjecting the hot rolled steel sheet to hot-band annealing under conditions of soaking temperature of 800° C. to 1200° C. (inclusive of 800° C. and 1200° C.) and soaking time of 2 seconds to 300 seconds (inclusive of 2 seconds and 300 seconds); and subjecting the hot rolled steel sheet to at least two cold rolling operations, which includes a final cold rolling, with intermediate annealing therebetween to obtain a cold rolled steel sheet having a final sheet thickness; and subjecting the cold rolled steel sheet to primary recrystallization annealing and then secondary recrystallization annealing, wherein a thermal treatment is carried out after the hot-band annealing and prior to at least one of the cold rolling operations so that the thermal treatment is not carried out immediately prior to the final cold rolling, wherein the thermal treatment is carried out at a temperature in the range of 500° C. to 750° C. (inclusive of 500° C. and 750° C.) for a period in the range of 10 minutes to 480 hours (inclusive of 10 minutes and 480 hours).

2. The method for manufacturing a grain oriented electrical steel sheet of claim 1, wherein temperature-increasing rate between 500° C. and 700° C. in the primary recrystallization annealing is at least 50° C./second.

3. The method for manufacturing a grain oriented electrical steel sheet of claim 1, further comprising subjecting the cold rolled steel sheet to magnetic domain refinement at a stage after the final cold rolling.

4. The method for manufacturing a grain oriented electrical steel sheet of claim 3, wherein the magnetic domain refinement is carried out by irradiating the steel sheet subjected to the secondary recrystallization annealing with electron beam.

5. The method for manufacturing a grain oriented electrical steel sheet of claim 3, wherein the magnetic domain refinement is carried out by irradiating the steel sheet subjected to the secondary recrystallization annealing with continuous-wave laser.

6. The method for manufacturing a grain oriented electrical steel sheet of claim 1, wherein the steel slab further contains by mass % at least one element selected from Ni: 0.005% to 1.5% (inclusive of 0.005% and 1.5%), Sn: 0.005% to 0.50% (inclusive of 0.005% and 0.50%), Sb: 0.005% to 0.50% (inclusive of 0.005% and 0.50%), Cu: 0.005% to 1.5% (inclusive of 0.005% and 1.5%), and P: 0.005% to 0.50% (inclusive of 0.005% and 0.50%).

7. The method for manufacturing a grain oriented electrical steel sheet of claim 2, further comprising subjecting the cold rolled steel sheet to magnetic domain refinement at a stage after the final cold rolling.

8. The method for manufacturing a grain oriented electrical steel sheet of claim 7, wherein the magnetic domain refinement is carried out by irradiating the steel sheet subjected to the secondary recrystallization annealing with electron beam.

9. The method for manufacturing a grain oriented electrical steel sheet of claim 7, wherein the magnetic domain refinement is carried out by irradiating the steel sheet subjected to the secondary recrystallization annealing with continuous-wave laser.

10. The method for manufacturing a grain oriented electrical steel sheet of claim 2, wherein the steel slab further contains by mass % at least one element selected from Ni: 0.005% to 1.5% (inclusive of 0.005% and 1.5%), Sn: 0.005% to 0.50% (inclusive of 0.005% and 0.50%), Sb: 0.005% to 0.50% (inclusive of 0.005% and 0.50%), Cu: 0.005% to 1.5% (inclusive of 0.005% and 1.5%), and P: 0.005% to 0.50% (inclusive of 0.005% and 0.50%).

11. The method for manufacturing a grain oriented electrical steel sheet of claim 3, wherein the steel slab further contains by mass % at least one element selected from Ni: 0.005% to 1.5% (inclusive of 0.005% and 1.5%), Sn: 0.005% to 0.50% (inclusive of 0.005% and 0.50%), Sb: 0.005% to 0.50% (inclusive of 0.005% and 0.50%), Cu: 0.005% to 1.5% (inclusive of 0.005% and 1.5%), and P: 0.005% to 0.50% (inclusive of 0.005% and 0.50%).

12. The method for manufacturing a grain oriented electrical steel sheet of claim 7, wherein the steel slab further contains by mass % at least one element selected from Ni: 0.005% to 1.5% (inclusive of 0.005% and 1.5%), Sn: 0.005% to 0.50% (inclusive of 0.005% and 0.50%), Sb: 0.005% to 0.50% (inclusive of 0.005% and 0.50%), Cu: 0.005% to 1.5% (inclusive of 0.005% and 1.5%), and P: 0.005% to 0.50% (inclusive of 0.005% and 0.50%).

13. The method for manufacturing a grain oriented electrical steel sheet of claim 4, wherein the steel slab further contains by mass % at least one element selected from Ni: 0.005% to 1.5% (inclusive of 0.005% and 1.5%), Sn: 0.005% to 0.50% (inclusive of 0.005% and 0.50%), Sb: 0.005% to 0.50% (inclusive of 0.005% and 0.50%), Cu: 0.005% to 1.5% (inclusive of 0.005% and 1.5%), and P: 0.005% to 0.50% (inclusive of 0.005% and 0.50%).

14. The method for manufacturing a grain oriented electrical steel sheet of claim 8, wherein the steel slab further contains by mass % at least one element selected from Ni: 0.005% to 1.5% (inclusive of 0.005% and 1.5%), Sn: 0.005% to 0.50% (inclusive of 0.005% and 0.50%), Sb: 0.005% to 0.50% (inclusive of 0.005% and 0.50%), Cu: 0.005% to 1.5% (inclusive of 0.005% and 1.5%), and P: 0.005% to 0.50% (inclusive of 0.005% and 0.50%).

15. The method for manufacturing a grain oriented electrical steel sheet of claim 5, wherein the steel slab further contains by mass % at least one element selected from Ni: 0.005% to 1.5% (inclusive of 0.005% and 1.5%), Sn: 0.005% to 0.50% (inclusive of 0.005% and 0.50%), Sb: 0.005% to 0.50% (inclusive of 0.005% and 0.50%), Cu: 0.005% to 1.5% (inclusive of 0.005% and 1.5%), and P: 0.005% to 0.50% (inclusive of 0.005% and 0.50%).

16. The method for manufacturing a grain oriented electrical steel sheet of claim 9, wherein the steel slab further contains by mass % at least one element selected from Ni: 0.005% to 1.5% (inclusive of 0.005% and 1.5%), Sn: 0.005% to 0.50% (inclusive of 0.005% and 0.50%), Sb: 0.005% to 0.50% (inclusive of 0.005% and 0.50%), Cu: 0.005% to 1.5% (inclusive of 0.005% and 1.5%), and P: 0.005% to 0.50% (inclusive of 0.005% and 0.50%).

17. The method for manufacturing a grain oriented electrical steel sheet of claim 1, wherein the thermal treatment is carried out as a batch annealing.

* * * * *